US006067830A

United States Patent [19]

Klages et al.

[11] Patent Number: 6,067,830

[45] Date of Patent: May 30, 2000

[54] METHOD AND APPARATUS FOR FORMING OPPOSING HOLES IN A SIDE WALL OF A TUBULAR WORKPIECE

[75] Inventors: Gerrald A. Klages, Woodstock; Blair J. Longhouse, Tillsonburg, both of Canada

[73] Assignee: TI Corporate Services Limited, London, United Kingdom

[21] Appl. No.: 09/361,998

[22] Filed: Jul. 28, 1999

[51] Int. Cl.[7] ..... B21D 28/28; B21D 26/02

[52] U.S. Cl. ..... 72/55; 72/336; 29/421.1; 83/53

[58] Field of Search ..... 72/55, 336, 56; 29/421.1; 83/22, 53, 177

[56] References Cited

U.S. PATENT DOCUMENTS

| | | | |
|---|---|---|---|
| 3,487,668 | 1/1970 | Fuchs, Jr. | 72/55 |
| 3,495,486 | 2/1970 | Fuchs, Jr. | 72/55 |
| 4,989,482 | 2/1991 | Mason | 83/22 |
| 5,398,533 | 3/1995 | Shimanovski et al. | 72/55 |
| 5,460,026 | 10/1995 | Schafer | 72/55 |
| 5,666,840 | 9/1997 | Shah et al. | 72/55 |
| 5,799,524 | 9/1998 | Schafer et al. | 72/55 |
| 5,816,089 | 10/1998 | Marando | 72/55 |

FOREIGN PATENT DOCUMENTS 0849012 6/1998 European Pat. Off. .

*Primary Examiner*—David Jones
*Attorney, Agent, or Firm*—Ridout & Maybee

[57] ABSTRACT

A method of cutting opposing holes in a side wall of a tubular workpiece and removing the cut out slugs, in which first and second axially aligned punches are applied to opposite side walls of a pressurized workpiece. The second punch has a larger width than the first punch, and reciprocates in a passageway extending laterally from the workpiece. The punches are reciprocated so that the first punch passes through both side walls, and first and second slugs are cut out. The end of the first punch is advanced toward the end of the second punch to capture the cut out slugs between the ends of the first and second punches, and the punches are moved so that the ends of the punches and the slugs captured between them progress along the passageway away from the workpiece. The ends of the punches are separated at a region of the passageway spaced from the workpiece, and the released slugs are removed from the ends of the punches.

22 Claims, 10 Drawing Sheets

METHOD AND APPARATUS FOR FORMING OPPOSING HOLES IN A SIDE WALL OF A TUBULAR WORKPIECE

The present invention relates to a method and apparatus for forming two opposing holes in a side wall of a tubular workpiece and for removing cut out slugs therefrom. Usually, the method will be applied while the tubular workpiece is internally pressurized, for example with pressurized water, and is undergoing hydroforming within a die cavity. Currently, hydroforming is used on a large scale for manufacture of frame components for road vehicles. Opposing or aligned holes are frequently required in tubular frame members and the like, for example for connecting mechanical fasteners therethrough.

In a known hole forming method, as described in commonly-assigned U.S. Pat. No. 4,989,482 (Mason) a reciprocal member or punch having a sharpened functional end pierces a side wall of a pressurized workpiece and cuts out a slug. As disclosed in Mason, the punch may be vented, for example by providing it with a bore communicating between the functional end and a lower pressure zone, in order to promote adherence of the cut-out slug to the functional end of the punch. This avoids problems of the cut-out slug becoming detached from the punch and falling into the workpiece and remaining at an unknown location within the workpiece after completion of the hole forming operation. This patent, however, discloses a procedure for forming a single hole and does not disclose a procedure for forming two aligned holes.

In a further known method, as described, for example in U.S. Pat. No. 3,495,486 (Fuchs), a member reciprocates in a passageway adjacent a pressurized workpiece. Initially, a functional end of the member is adjacent to and supports the side wall of the workpiece. The functional end retracts away from the workpiece, and the internal pressure acts in the fashion of a liquid punch, causing a slug to be severed from the side wall in the unsupported area along a line corresponding to the periphery of the passageway. The patent does not describe severing holes that are opposingly aligned, and does not deal with the problem of disposal of the slugs after hole formation.

U.S. Pat. No. 5,666,840 (Shah et al) discloses a procedure wherein a punch pierces two aligned holes in a hydroformed tube. The punch is vented and it appears that slug adherence to the cutting end of the punch is promoted. The process relies on the pressurization of the liquid within the tube to supply the pressure that dislodges the slugs from the end of the punch. As a result, it is required that pressurization is maintained during and after formation of the second hole and this in turn results in the design limitation that the second hole has to be of the same size as the punch, so that the punch seals the hole as it passes through. Further, since the passageway in the die or in the die button adjacent the second hole is of the same size as the punch, there is risk of rapid wear or of breakage of the punch, since any slight misalignment will result in the punch striking the sides of the die button. A further disadvantage of the arrangement described is that if for any reason pressurization within the tube is lost, a slug may be drawn back into the tube and deposited within the tube when the punch is retracted. Since the slug may adhere to a water film on an interior side wall of the tube, the presence of the slug may then not be revealed until after the water film has dried out after the tube product has been shipped or has been incorporated into a vehicle frame or other product, leading to a rattling nuisance which may be difficult or impossible for the purchaser to remedy.

The present invention provides methods and apparatus whereby these and other disadvantages may be avoided.

According to the present invention there is provided a method of cutting opposing holes in a side wall of a tubular workpiece and removing cut out slugs therefrom, comprising the steps of:

(a) pressurizing the workpiece;

(b) providing first and second axially aligned reciprocating members each having a functional end, said functional ends disposed for application to first and second opposite wall portions of the workpiece, respectively, and the second member having a larger transverse dimension than said first member and reciprocating in a passageway extending laterally from said workpiece;

(c) passing said first member through said first and second wall portions;

(d) cutting first and second slugs from said first and second wall portions of the workpiece, respectively;

(e) advancing the functional end of the first member toward the functional end of the second member and capturing the cut out slugs between the functional ends of the first and second members;

(f) moving said members so that the functional ends of the members and the slugs captured therebetween progress along said passageway in a direction laterally away from the workpiece;

(g) separating the functional ends of said members at a region of the passageway spaced from the workpiece; and (h) removing the slugs from the functional ends.

With the method in accordance with the invention, the passageway within which the second member reciprocates is of larger transverse dimension than the first member, so that the hole formed in the side wall of the tubular workpiece adjacent the second member is wider than the hole formed adjacent the first member, and there is a clearance between the first member and the sides of the passageway, so that risk of impingement of the first member on the sides of the passageway is considerably reduced or avoided. The slugs captured between the opposed first and second members are moved together as a unit to a point outside the tube where they are positively released by separation of the functional ends of the members, at which point positive slug removal techniques can be applied such as application of compressed air and pressurized fluids to separate the slugs from the first and second members and ensure that slugs are not carried back into the interior of the tube workpiece. Further, the method described is well adapted to employ pressure from a source other than the liquid used to pressurize the tube to dislodge the slugs from the ends of the first and second members.

The invention also provides apparatus for cutting opposing holes in a side wall of a pressurized tubular workpiece and for removing cut out slugs therefrom, comprising:

(a) first and second dies opposable to confine said pressurized workpiece;

(b) a first member reciprocating in a first passageway in the first die and having a functional end for application to a first wall portion of the workpiece;

(c) a second member reciprocating in a second passageway in the second die axially aligned with the first member and having a functional end for application to a second wall portion of the workpiece opposite said first wall portion, said second member and said second passageway having a transverse dimension greater than said first member;

(d) a slug disposal cross passage in the second die communicating with one side of the second passageway at a region spaced from the workpiece;

(e) reciprocating drives for the first and second members, respectively, and operable to reciprocate said first member between positions having its functional end adjacent the first wall portion and adjacent the cross passage, respectively and to reciprocate the second member between positions having its functional end adjacent the second wall portion and adjacent the cross passage, respectively;

(f) and a first source of pressure connectible to said cross passage for displacing slugs along said cross passage.

Other advantages of the present invention will become apparent from consideration of the following detailed description, taken together with the accompanying drawings, which are by way of example only.

Figure 1:
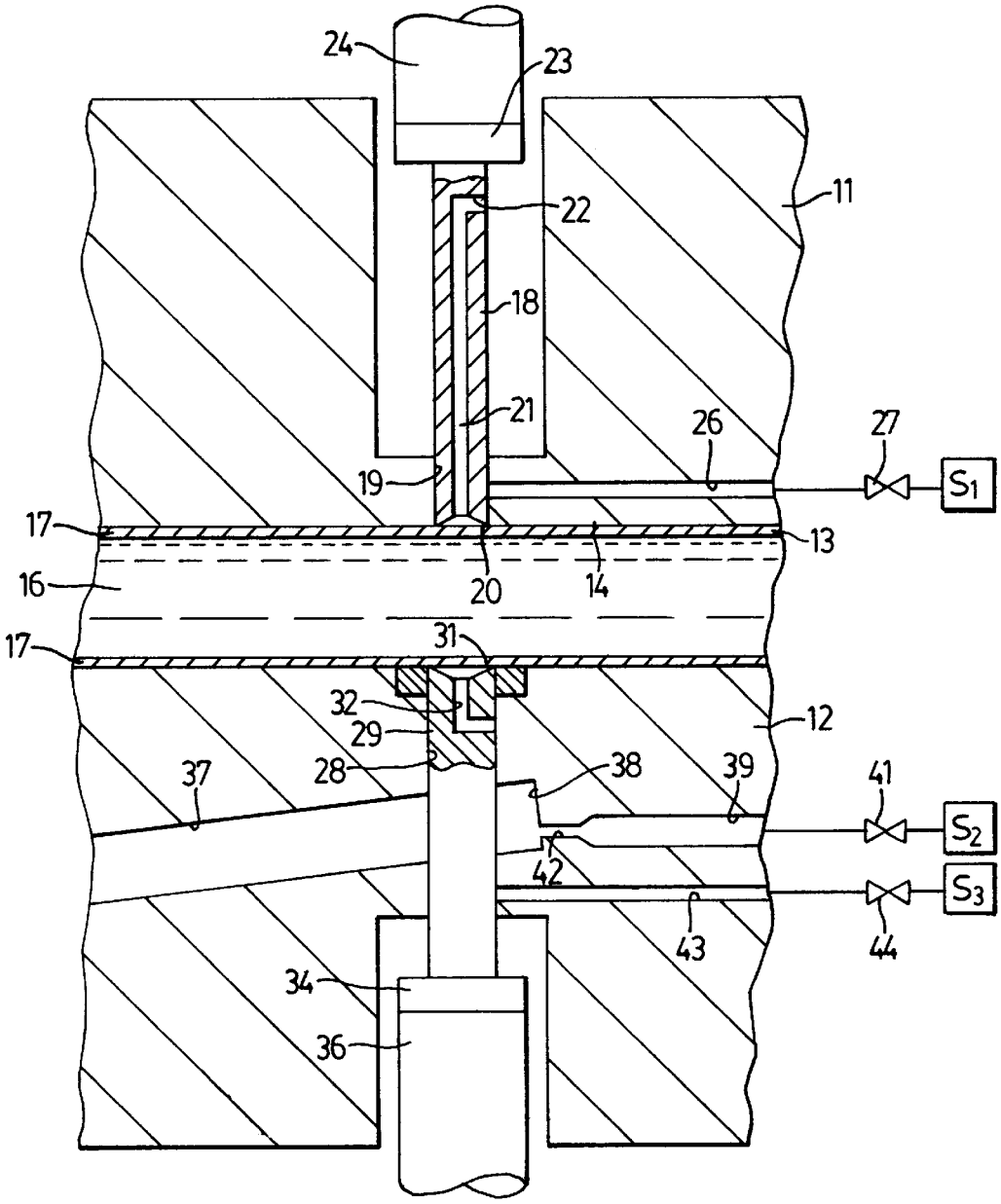
FIG. 1 shows somewhat schematically and partially in cross-section a portion of a hydroforming die before commencing a punching operation.

Referring to the accompanying drawings, wherein like reference numerals indicate like parts, and firstly to the method illustrated in FIGS. 1 to 4, FIG. 1 shows a press having upper and lower dies 11 and 12 employed in a hydroforming operation wherein a workpiece in the form of a tube 13 is confined within a cavity 14 defined between the dies 11 and 12 in closed position.

In a preferred form, the ends of the tube 13 may be sealed and a fluid, usually water, 16, filled into the tube 13. The fluid may be, and preferably is, pre-pressurized before closing the dies 11 and 12 together. After die closure the fluid 16 is further pressurized in order to cause the tube wall 17 to conform to the contours of the cavity 14. Often, the hydroformed tube product will be of a non-circular, for example generally rectangular, cross-section. Pre-pressurization, hydroforming, filling and sealing procedures are described in more detail in commonly assigned U.S. Pat. Nos. Re 33,990 (Cudini) 5,235,836 (Klages, et al.), 5,445,002 (Cudini et al.), and 5,644,829 (Mason et al.), the disclosures of all of which are incorporated by reference herein.

A first member or punch 18 reciprocates in a passageway or bore 19 that extends laterally of the die cavity defined by the upper die 11. The structure and the function of the punch 18 may be similar to those described in commonly assigned U.S. Pat. No. 4,989,482 (Mason), the disclosures of which are incorporated by reference herein. The punch 18 has a functional or leading end 20 that may be, but need not be, sharpened to define a cutting edge, and in the preferred form, has an axial bore 21 extending inwardly from the functional end 20 and communicating with a cross-bore 22 that vents to the exterior of the punch 18. The punch 18 is retained in a holder 23 coupled to a device 24 for effecting reciprocation of the punch 18. For example, the punch holder 23 may be connected to the piston of a hydraulic piston and cylinder arrangement of which the cylinder (not shown) is connected to the die 11.

A supply cross-bore 26 passes through the die 11 and connects at one end in the lateral bore 19. The bore 26 is coupled through valving 27 to a source of pressurized fluid $S_1$, for example compressed air.

Figure 3:
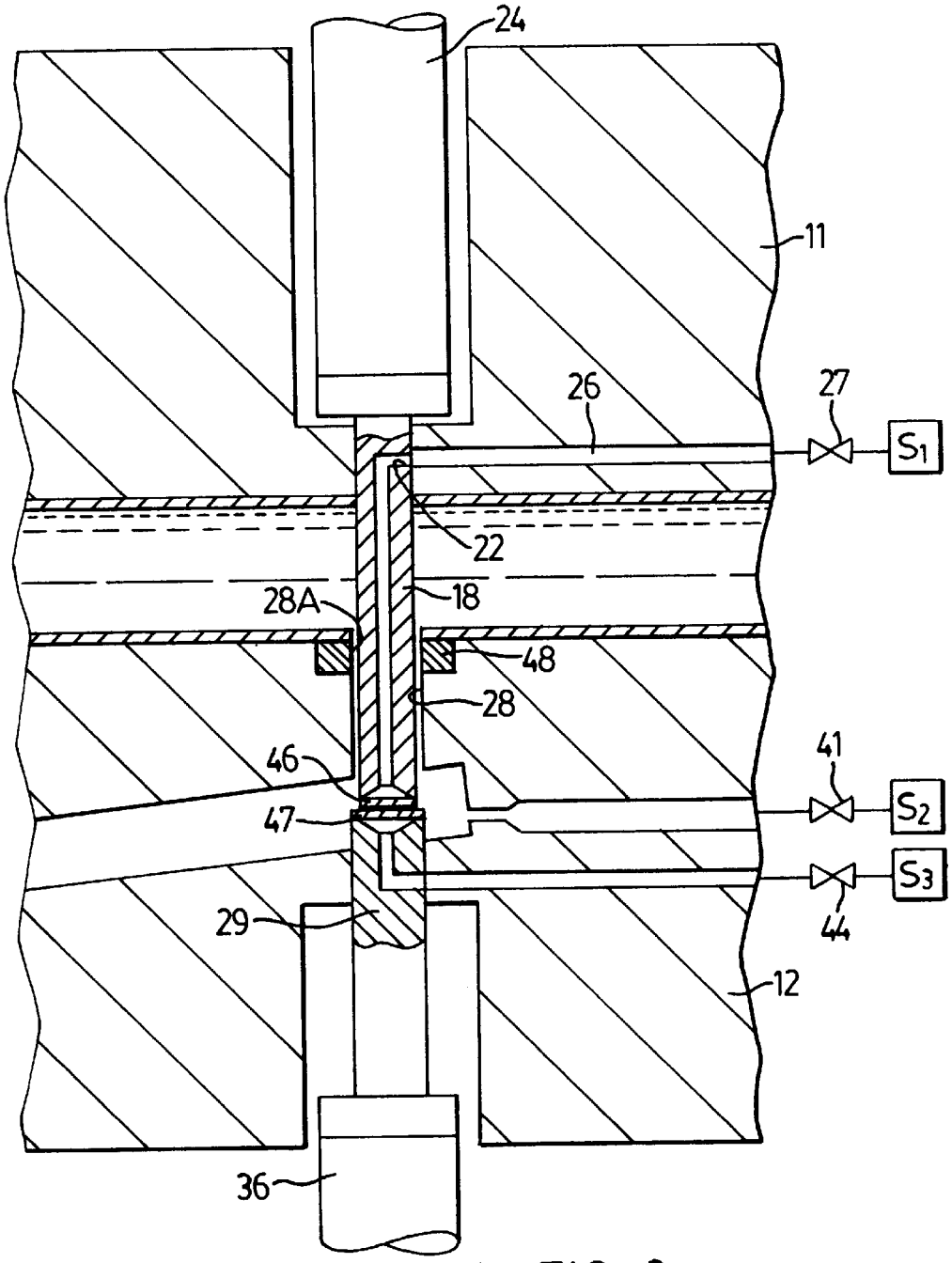

Die 12 has a passage or bore 28 aligned with passageway 19 and extending laterally of the die cavity 14 defined by the die 12. A second member 29 reciprocates within the passageway 28. The second member 29 and passageway 28 are somewhat wider than the first member 18 and passageway 19, and, in a preferred form, in an advanced position of the punch 18, as seen in FIG. 3 the punch 18 passes through the passageway 28 with clearance on all sides. For example, the punch 29 and passageway 28 may be about 0.5 to about 300% wider than punch 18, more preferably about 5 to 100%, and still more preferably about 10 to about 20% wider than punch 18, based on the width dimensions of the punch 18. The member 29 has a functional or leading end 31 that may be, but need not be, sharpened to define a cutting edge. The member 29 preferably has an axial bore 32 extending from its functional end to a cross-bore 33 that vents to the exterior of the member 29. The member 29 is retained in a holder 34 that is coupled to a device 36 for effecting reciprocation of the member 29. For example, the holder 34 may be connected to the piston of a hydraulic piston and cylinder arrangement of which the cylinder (not shown) is connected to the die 12.

A slug disposal chute or cross passage 37 intersects passageway 28 and on one side inclines downwardly toward an end (not shown) exiting at one side of the die 12. An inner end 38 of the chute 37 on the opposite side of passageway 28 connects to a supply bore 39 passing through the die 12 and connected through a valve 41 to a source $S_3$ of pressurized fluid, for example water under pressurization. The bore 39 may connect to passage 38 through a portion which may be constricted to a jet-like constriction 42, but need not be. A further supply bore 43 passes through the die 12 and connects at one end with a laterally outer portion of the passageway 28 and at an opposite end through a valve 44 to a source $S_3$ of pressurized fluid, for example compressed air.

In operation, initially both first and second members 18 and 29 are positioned as seen in FIG. 1 with their functional ends 20 and 31 flush with the adjacent surfaces of the die cavity 14 in the dies 11 and 12, respectively, and outwardly adjacent first and second side wall portions of the fluid pressurized tube 13.

Figure 2:
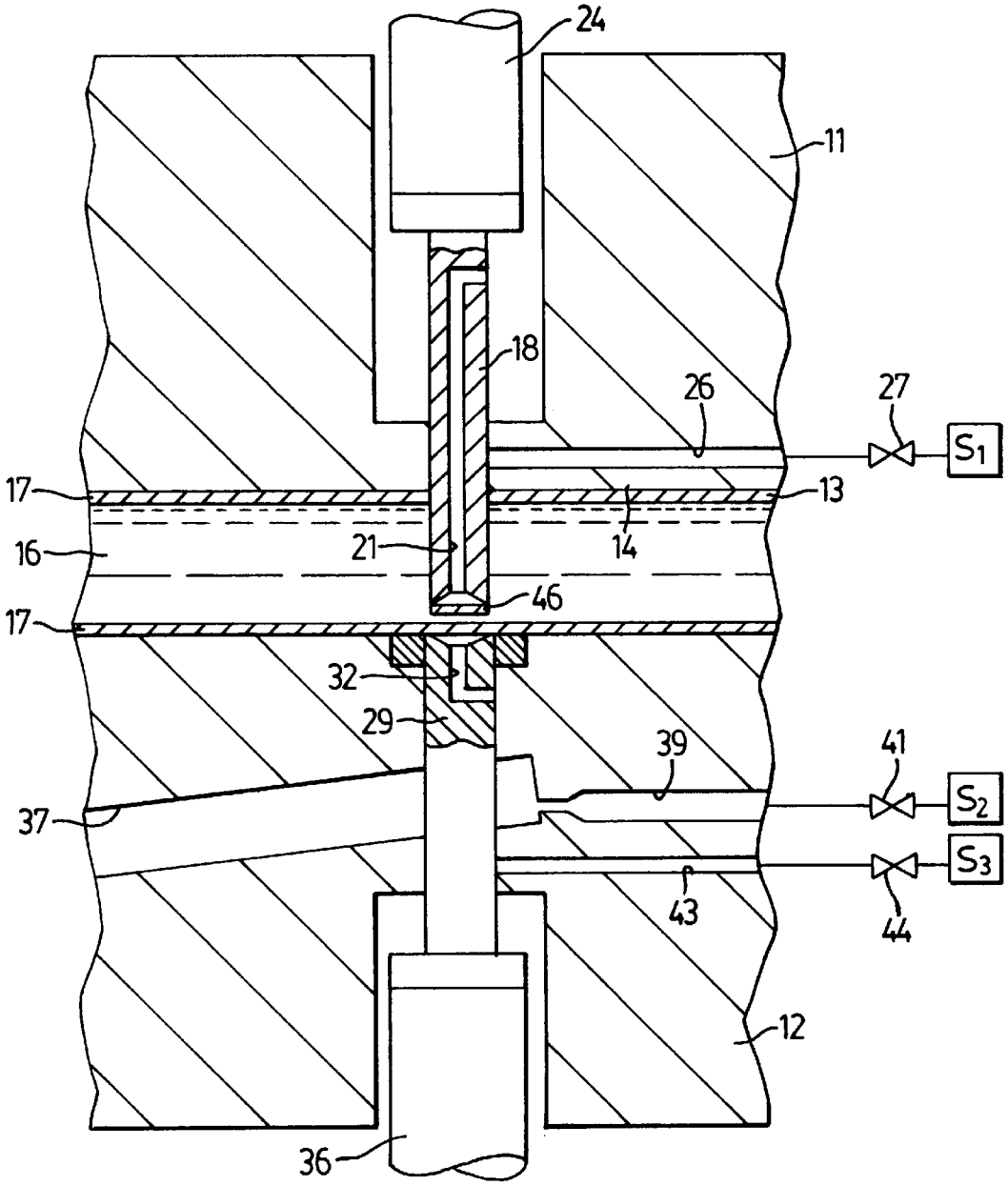
FIGS. 2 to 4 show, respectively, successive stages in the punching and slug removal operations.

In one form of the present method, shown in FIGS. 1 to 4, device 24 is actuated to advance the functional end 20 of punch 18 through the adjacent portion of the tube wall 17 and shear out a slug 46. As seen in FIG. 2, the functional end 20 of the punch 18 tends to carry the slug 46 forwardly with it. Where, as in the preferred form, the punch 18 has a venting bore 21, adhesion of the slug 46 to the functional end 20 and clean shearing away of the slug 46 from the tube wall 17 are promoted by the pressure difference existing between the interior of the tube 13 and the interior of the bore 21, which is at reduced pressure as compared to the fluid 16, and, in the preferred form, is substantially at atmospheric pressure.

At the point at which the slug 46 contacts the inner surface of the second side wall portion of the side wall 17 in the region opposite the passageway 19, the device 36 is actuated to allow retraction of the member 29, as seen in FIG. 3. For example, in the case in which the device 36 is connected to the piston of a hydraulic piston and cylinder arrangement, valving connected to the cylinder may be operated to allow relief of pressure from the cylinder on the extension side of the piston. Optionally, the device 36 may be operated initially to retract member 29 positively away from the tube workpiece 13 at the time at which the slug 46 contacts the second side wall portion, and, after a short time, relief from the extension side of the piston is allowed as described above. As a result of the combination of the impact of the slug 46 on the inner side of the sidewall portion 17, the pressure exerted by the pressurized fluid 16 within the tube 13, and the withdrawal of the member 29, a second slug 47 is punched from the sidewall portion 17 in the region adjacent the passageway 28. While the device 24 and the punch 18 continue to advance toward the extended position seen in FIG. 3, the member 29 together with the holder 34 and device 36 are pushed rearwardly, so that the slugs 46 and 47 are captured compressively between the functional ends 20 and 31 of the punch 18 and member 29, respectively, and are conveyed positively in captured condition late rally to the position seen in FIG. 3. Up to the point at which the functional ends 20 and 31 come into opposition with the slugs 46 and 47 compressively captured between them, the slugs 46 and 47 remain positively located and retained on the function ends 20 and 31 by virtue of the pressure differential between the liquid within the tube 13 and the interior of the axial vent bores 21 and 32. As a result the slug 47, for example is cleanly sheared from and does not tend to remain attached to the side wall 17 of the tube 13.

Since the passageway 28 has a greater width dimension than the punch 18, the second slug 47 has a greater width dimension than the slug 46. Further, it will be noted from FIG. 3 that, as the punch 18 advances there is a clearance on all sides between the sides of the punch 18 and the passageway 28.

To avoid excessive wear of the material of the lower 20 die 12 resulting from the stresses exerted by the severing of the second slug 47, the lower die 12 may be provided in the region of the opening of the passageway 28 with an insert 48 or die button having an opening 28A through it that defines the mouth of the passageway 28. The insert or die button 48 may be, for example, of hardened steel.

The punch 18 advances until a position is reached, as indicated in FIG. 3, in which the device 24 reaches its limit of travel in the extension direction. For example, such limit may be defined by the piston connected to the device 24 reaching a limit of movement defined by the walls of the cylinder (not seen) within which the piston works.

It will be noted that, in this extreme extended or advance position, as seen in FIG. 3, the cross bore 22 in the punch 18 aligns with the supply bore 26 in the die 11.

Figure 4:
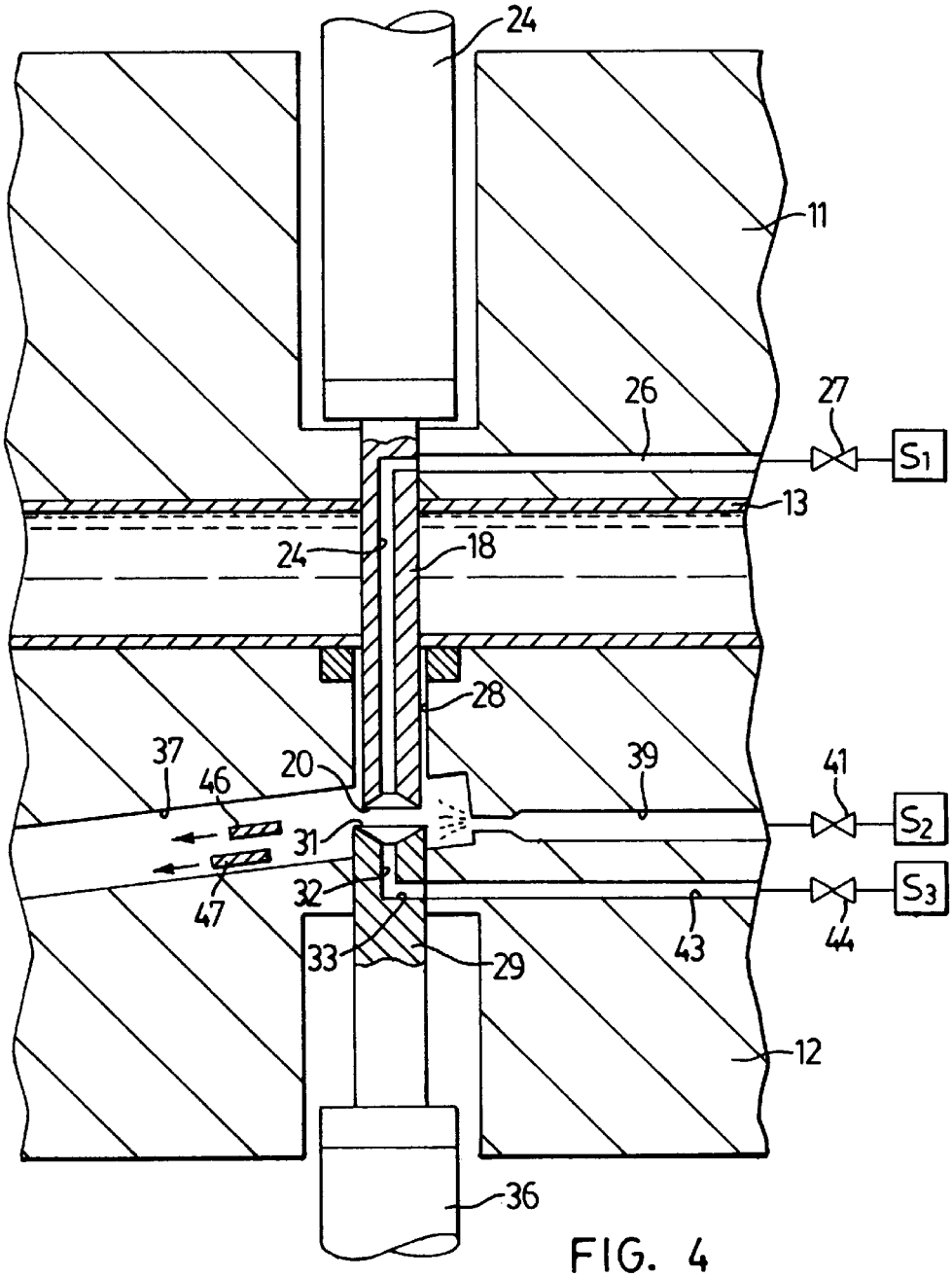

While the punch 18 is stopped, the member 29 is actuated by the device 36 to continue its retraction away from the tube 13 to an extreme limit of retraction shown in FIG. 4. This may be effected by, for example, applying pressure on the retraction side of a piston of a piston and cylinder arrangement to which the device 36 is connected. Again, such limit of retraction may be defined by the piston coupled to the device 36 reaching a limit of motion within the cylinder within which the piston works.

It will be noted that, in the position seen in FIG. 4 the cross bore 33 in the member 29 aligns with the supply bore 43 in the die 12.

In the position shown in FIG. 4, the functional ends 20 and 31 of the members 18 and 29, respectively, are separated from one another, so that the slugs 46 and 47 are released and are no longer captured compressively between the functional ends 20 and 32.

The valves 27, 41 and 44 are opened, so that compressed air is supplied along the supply bores 26 and 43 from the sources $S_1$ and $S_3$, respectively, and pressurized gas is supplied to the axial bores 21 and 32 propelling the slugs 46 and 47 in the direction axially away from the functional ends 20 and 31 of the members 18 and 29, respectively. At the same time, water under pressurization, for example under head of liquid or under gas pressurization is forced along the supply bore 39, and from which it emerges into chute 37 in a forcible spray indicated by broken lines in FIG. 4, tending to wash the slugs 46 and 47 downwardly along the slug disposal chute 37, as indicated by the arrows in FIG. 4. Water escaping from the tube 13 along the annular passageway between the punch 18 and the passageway 28 flows into the chute 37 and may assist washing the slugs 46 and 47 to the exit. The removed slugs may be collected in a bin or the like disposed adjacent the exit end of the chute 37 adjacent the side of the lower die 12.

The devices 24 and 36 are actuated to restore the punch 18 and member 28 to the position shown in FIG. 1 wherein the functional ends 20 and 31 of the members are positioned flush with the adjacent surfaces of the cavity 14 in the dies 11 and 12, respectively.

The ends of the tube 13 are unsealed, and any remaining liquid is allowed to drain from the tube 13, and the dies 11 and 12 are opened to release the hydroformed and apertured workpiece.

A new tubular workpiece may then be placed between the open dies 11 and 12, the workpiece sealed, filled, preferably pre-pressured, and the dies 11 and 12 moved to the closed position, the workpiece hydroformed, and the cycle of operation described above with reference to FIGS. 1 to 4 repeated.

In the preferred form, the operation of the actuation devices 24 and 36 and of the valves 27, 41 and 44 is controlled automatically. Such automatic control is well known and well understood by those skilled in the art, and need not be described in detail herein. For example, the automatic control may be effected through timers, or through logic circuits operated by proximity switches actuated by the devices 24 and 36.

Figure 5:
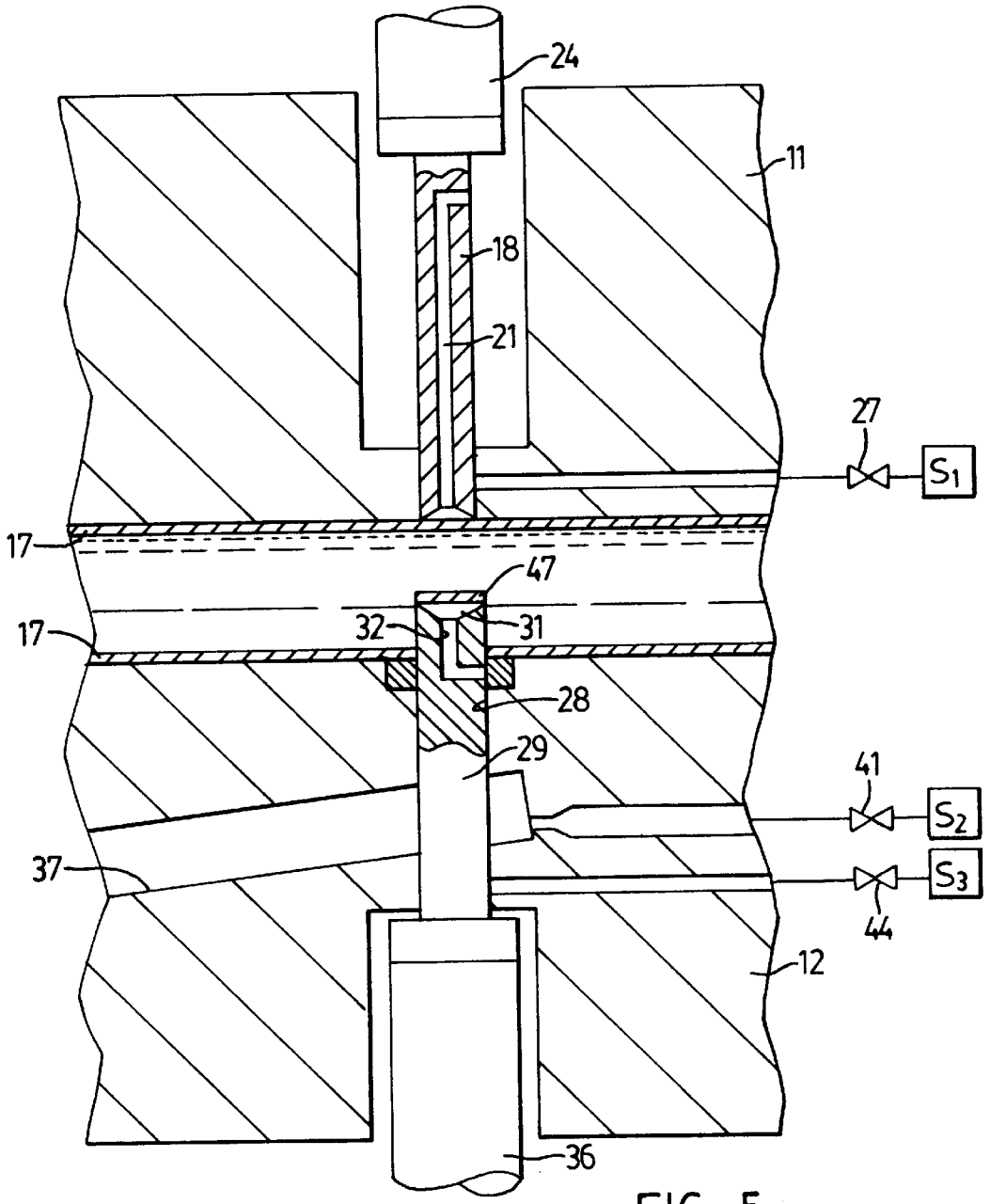
FIG. 5 illustrates a modified form of the punching method.
Figure 6:
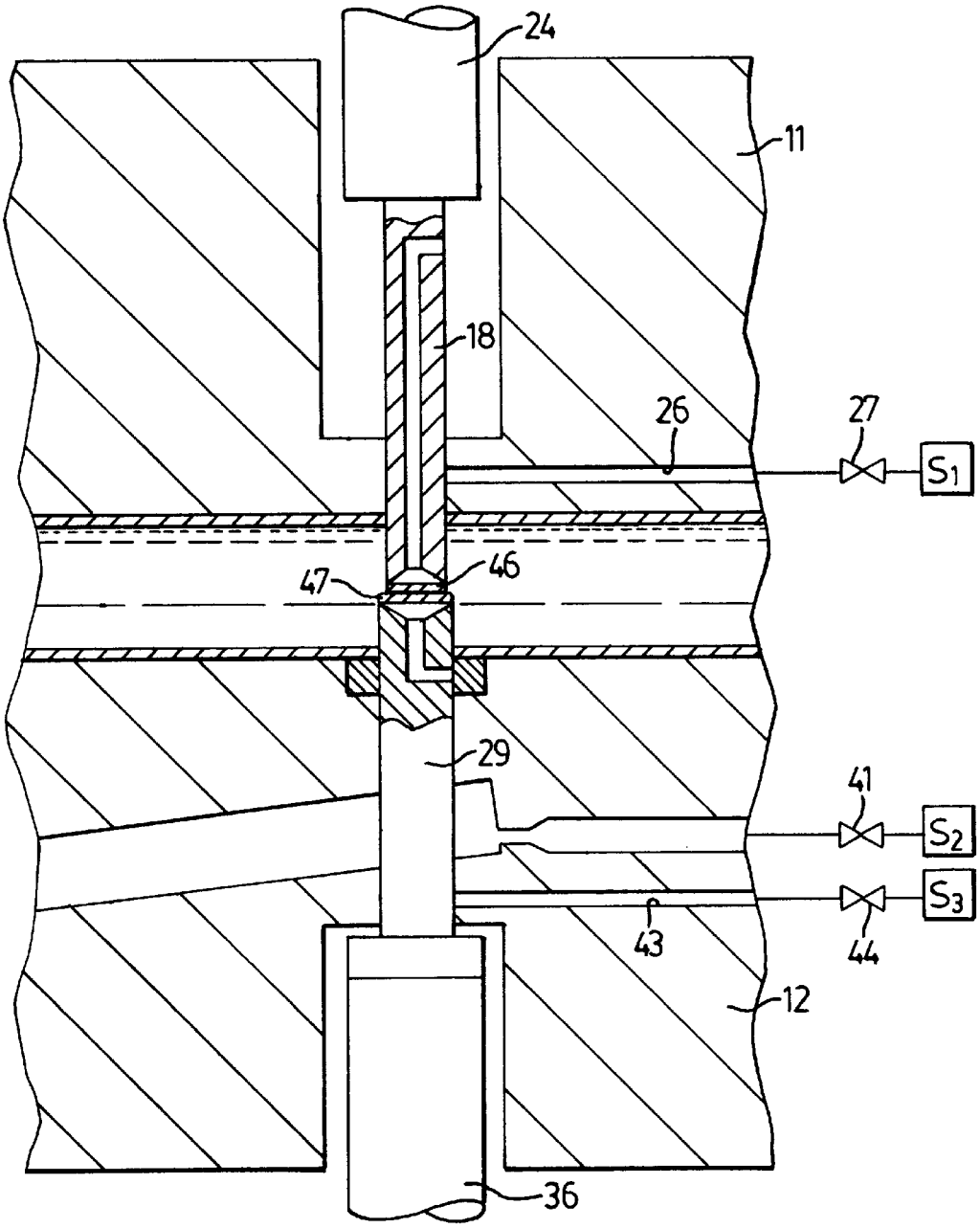
FIG. 6 shows a subsequent stage in the modified method according to FIG. 5.

In a second example of a form of the present method described below with reference to FIGS. 5 and 6, the member 29 functions as a punch, and preferably has a sharpened functional or leading end 31.

Initially the members 18 and 29 are in the position shown in FIG. 1. The device 36 is actuated to drive the punch 29 through the sidewall 17 of the pressurized tube 13, shearing out a slug 47 and forming a corresponding opening in the sidewall 17. The slug 47 tends to be carried on the leading end 31 of the punch 29 as it travels to an approximately central position within the tube 13, as seen in FIG. 5. Adhesion of the slug 47 to the leading end 31 may be promoted in the preferred form by the pressure differential existing between the fluid 16 within the tube 13 and the interior of the bore 32 within the punch 29. While the punch 29 is a close fit within the passageway 28, normally the fit between the punch 29 and the passageway 28 is not gas tight, so that the interior of the passageway 32 may be, at least to some extent, vented to the atmosphere. If desired, in order to reduce leakage of pressurized water from the interior of the tube 13, and maintain a desired degree of pressurization within the tube 13, after the slugs 46 and 47 are sheared from the side wall 17 of the tube, the passageways 19 and 28 may be equipped with O-rings that may be captured in an annular recess in the side wall of the passageway 19 or 28 and that engage the sides of the punches 18 and 29 and form a seal between the side wall of the passageway 19 or 28 and the adjacent punch 18 and 29 in a conventional manner.

The device 24 is then actuated to drive the punch 18 through the adjacent sidewall 17, severing out a slug 46 of smaller width dimension than slug 47. Punch 18 continues to advance to the position as shown in FIG. 6, wherein the slugs 46 and 47 are compressively captured between the leading ends of the members 18 and 29. Punch 18 is advanced while punch 29 is allowed to retract, for example by relieving pressure on the extension side of a piston connecting to device 36 as described above with reference to FIG. 3. The punch 18 pushes the punch 29 together with the captured slugs 46 and 47 that remain trapped together between the functional ends of the members 18 and 29. While captured in this fashion the slugs 46 and 47 are bodily displaced to the position shown in FIG. 3, at which the member 18 reaches its limit of extension. The remainder of the cycle of operation is then as described above with reference to FIGS. 3 and 4, wherein the member 29 is further retracted, the slugs 46 and 47 displaced by compressed air supplied along the supply bores 26 and 43 and the liberated slugs washed down the slug chute with a jet of water supplied from the constriction 39.

The punches 18 and 29 are then restored to the FIG. 1 position, the apertured workpiece 13 is then unsealed, drained and removed from the press after opening of the dies 11 and 12. A new workpiece may then be inserted within the press and the cycle of operation described above with reference to FIGS. 5 and 6 repeated.

Figure 7:
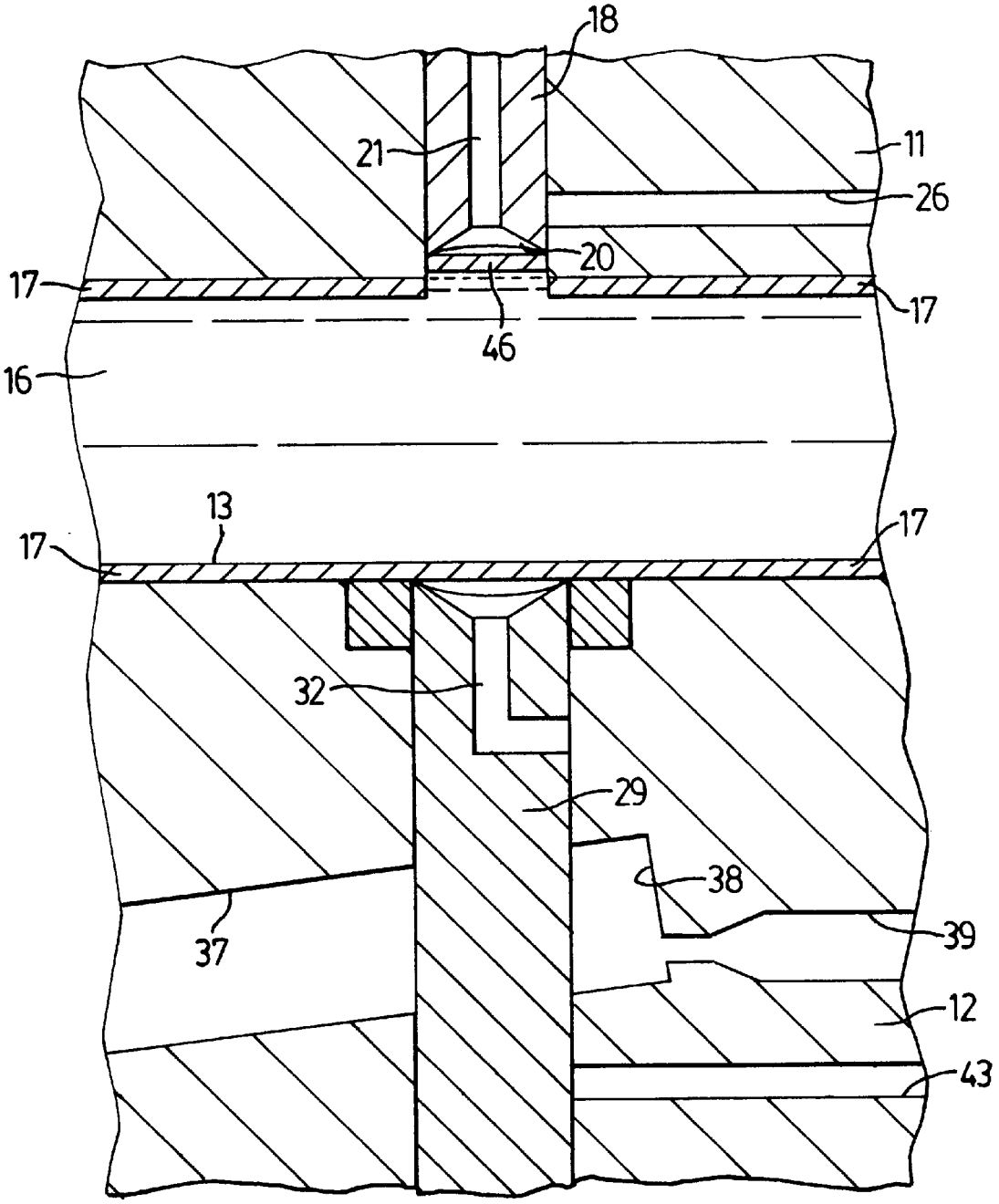
FIGS. 7, 8, 9 and 10 show further modified forms of the punching method, respectively.

A third form of the present method is shown in FIG. 7. With the punches 18 and 29 initially at the FIG. 1 position, punch 18 is retracted, as seen in FIG. 7 to allow the pressure in tube 13 to punch out a slug 46 which adheres to the functional end 20 of the punch 18.

Punch 18 carrying the slug 46 may then be advanced to the FIG. 2 position and the sequence of operations described above with reference to FIGS. 2, 3 and 4 is followed.

Figure 8:
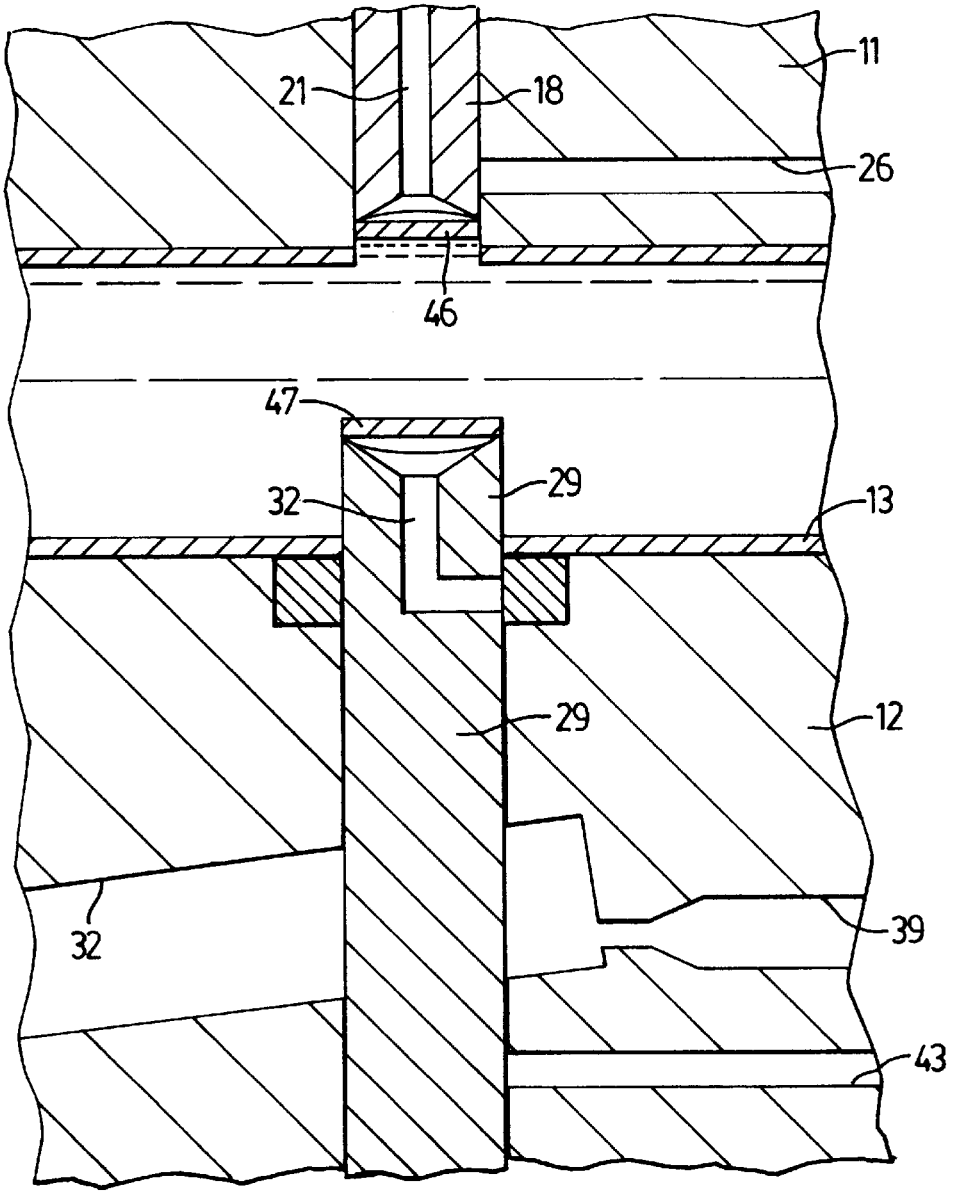

In a fourth form of the method, firstly the procedure described above with reference to FIG. 7 is followed, then punch 29 is advanced as seen in FIG. 8 carrying a slug 47 to an inner position within the tube 13. The punch 18 is advanced to the position seen in FIG. 6 and the procedure described above with reference to FIGS. 6, 3 and 4 is followed.

Figure 9:
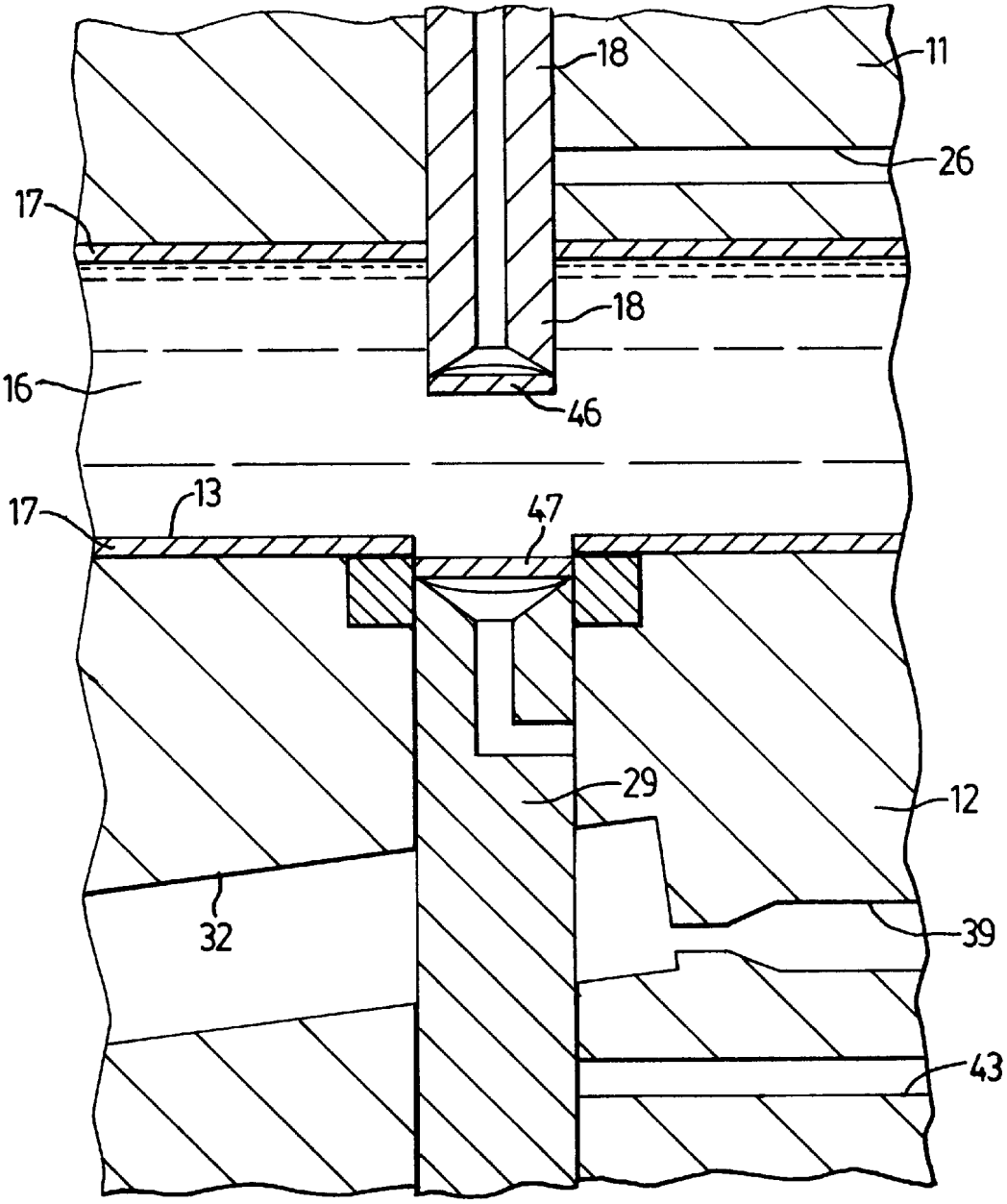

In a fifth form of the method, as seen in FIG. 9, firstly punch 18 is advanced to shear out slug 46, while punch 29 is retracted so that liquid pressure within the tube 13 shears out a slug 47. Punch 18 is then advanced while punch 29 is allowed to retract and the procedure described above with reference to FIGS. 3 and 4 is followed.

Figure 10:
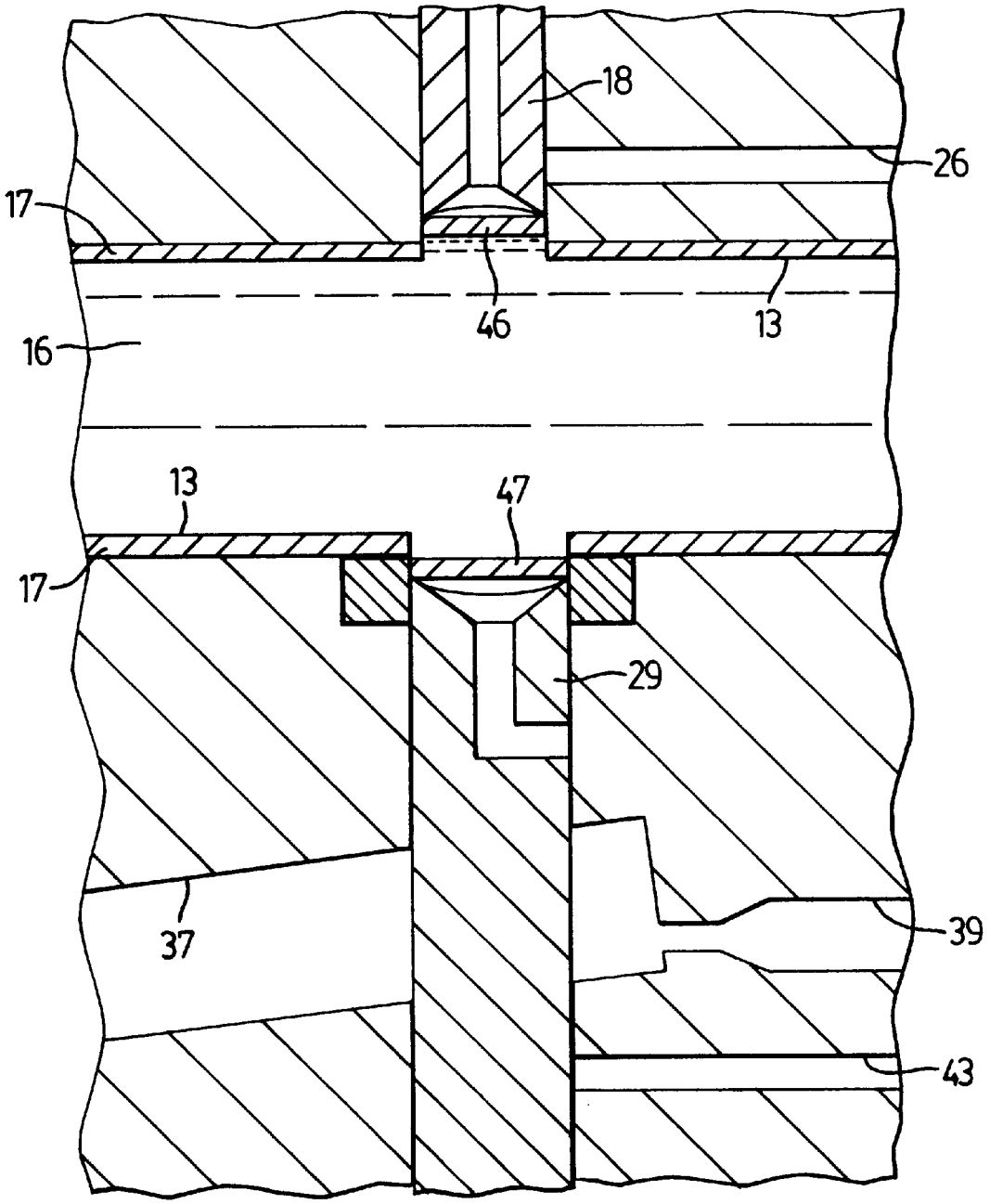

In a sixth form of the method, initially both punches 18 and 19 are retracted as seen in FIG. 10 to allow pressure in the tube 13 to shear out slugs 46 and 47. Punch 18 is then advanced while slug 29 is allowed to retract and the procedure described above with reference to FIGS. 3 and 4 is followed.

The cross-sections of the members 18 and 29, and hence of the slugs sheared out by their functional ends and of the apertures formed in the sidewall 17 may be of any desired outline. For example, they may be circular, elliptical, triangular, rectangular, polygonal or any simply or complexly curved shape. While the member 29 and its passageway 28, including the passageway 28*a* through the die button 48, if present, have a width or transverse dimension larger than the corresponding dimension of the member 18 and passageway 19, not all transverse dimensions of the member 29 need be larger than the member 18, and it is merely desired that the member 18 should pass through the passageway 28 with clearance on all sides. Thus, for example, the cross-sectional area of the punch 18 when projected onto the cross-section of the member 29 may exhibit a margin or clearance around all its edges inwardly from the cross-sectional perimeter of the member 29 whereby risk of the punch 18 striking the sides of the passageway 28 or the die button 48 can be avoided.

The above described method offers the further advantage that the slugs 46 and 47 are cleanly severed from the wide walls 17 of the tube 13 and positively captured and displaced from the tube 13 to the interior of the chute 37 spaced from the workpiece where they are released and disposed of positively along the chute 37, thereby eliminating risk of the slugs 46 and 47 being carried back or remaining within the tube workpiece 13.

It may be noted that advantageously the side wall 17 of the tube 13 adjacent the hole formed by the shearing out of the slug 46 tends to be indented inwardly toward the middle of the tube 13 by reason of the inward movement of the slug 46 carried by the punch 18 while on the opposite side the periphery of the hole formed by removal of the slug 47 tends to be formed flush with the tube side wall 17 since the outward movement of the larger slug 47 tends to urge the side wall 17 outwardly against the surface of the die cavity 14. This shaping of the peripheries of the holes is especially convenient and desirable for attachment of mechanical fasteners passed through the aligned holes.

We claim:

1. A method of cutting opposing holes in a side wall of a tubular workpiece and removing cut out slugs therefrom, comprising the steps of:

(a) pressurizing the workpiece;

(b) providing first and second axially aligned reciprocating members each having a functional end, said functional ends disposed for application to a first wall portion of the workpiece and a second wall portion of the workpiece opposite said first wall portion, respectively, and the second member having a larger transverse dimension than said first member and reciprocating in a passageway extending laterally from said workpiece;

(c) passing said first member through said first and second wall portions;

(d) cutting first and second slugs from said first and second wall portions of the workpiece, respectively;

(e) advancing the functional end of the first member toward the functional end of the second member and capturing the cut out slugs between the functional ends of the first and second members;

(f) moving said members so that the functional ends of the members and the slugs captured therebetween progress along said passageway in a direction laterally away from the workpiece;

(g) separating the functional ends of said members at a region of the passageway spaced from the workpiece; and (h) removing the slugs from the functional ends.

2. A method as claimed in claim 1 wherein said first member has a cutting functional end and steps (c) and (d) comprise advancing the first member through said first wall portion toward said second wall portion and allowing said second member to retract laterally away from the workpiece after the first member approaches said second wall portion.

3. A method as claimed in claim 1 wherein said first and said second member each have a cutting functional end and steps (c) and (d) comprise advancing said first and second members through said first and second wall portions, respectively, toward an inner portion of the workpiece and advancing said first member through said second wall portion while allowing said second member to retract laterally outwardly from the workpiece.

4. A method as claimed in claim 1 wherein step (c) comprise retracting said first member laterally away from the workpiece, and advancing said first member laterally toward and through said second wall portion.

5. A method as claimed in claim 1 wherein steps (c) and (d) comprise retracting said first member laterally away from the workpiece, advancing said first member laterally toward and through said second wall portion and allowing said second member to retract laterally away from the workpiece.

6. A method as claimed in claim 5 wherein said second member is retracted before said first member approaches said second wall portion.

7. A method as claimed in claim 4 wherein said second member is retracted after said first member approaches said second wall portion.

8. A method as claimed in claim 1 wherein steps (c) and (d) comprise advancing the first member through said first and second wall portions and allowing said second member to retract away from said workpiece before said first member approached said second wall portion.

9. A method as claimed in claim 1 wherein steps (c) and (d) comprise retracting said first and second members away from said workpiece and advancing said first member through said first and second wall portions.

10. A method as claimed in claim 1 wherein each of said first and second members has an axial bore communicating between the functional end and a rearward portion of the member, and step (h) comprises applying pressurization along each said axial bore from a region external of the workpiece.

11. A method as claimed in claim 10 wherein each of said first and second members has a cross bore communicating with the axial bore and that aligns with a pressure conduit connected to a source of pressurization.

12. A method as claimed in claim 11 wherein said first and second members reciprocate within first and second dies, and each said pressure conduit comprises a bore extending within each of said first and second dies, respectively.

13. A method as claimed in claim 1 wherein said passageway communicates with a cross passage at said region spaced from the workpiece and step (h) comprises applying pressurization from a portion of the cross passage on one side of the passageway and displacing the slugs toward a portion of the cross passage on a side of the passageway opposite said one side.

14. Apparatus for cutting opposing holes in a side wall of a pressurized tubular workpiece and for removing cut out slugs therefrom, comprising:

(a) first and second dies opposable to confine said pressurized workpiece;

(b) a first member reciprocating in a first passageway in the first die and having a functional end for application to a first wall portion of the workpiece;

(c) a second member reciprocating in a second passageway in the second die axially aligned with the first member and having a functional end for application to a second wall portion of the workpiece opposite said first wall portion, said second member and said second passageway having a transverse dimension greater than said first member;

(d) a slug disposal cross passage in the second die communicating with one side of the second passageway at a region spaced from the workpiece;

(e) reciprocating drives for the first and second members, respectively, and operable to reciprocate said first member between positions having its functional end adjacent the first wall portion and adjacent the cross passage, respectively and to reciprocate the second member between positions having its functional end adjacent the second wall portion and adjacent the cross passage, respectively;

(f) and a first source of pressure connectible to said cross passage for displacing slugs along said cross passage.

15. Apparatus as claimed in claim 14 wherein said first member has a cutting functional end.

16. Apparatus as claimed in claim 14 wherein said second member has a cutting functional end.

17. Apparatus as claimed in claim 14 wherein the reciprocating device for the first member is operable to retract the first member away from the workpiece.

18. Apparatus as claimed in claim 14 wherein the reciprocating die for the second member is operable to extend the second member through the second wall portion toward an inner portion of the workpiece.

19. Apparatus as claimed in claim 14, wherein each of said first and second members has an axial bore communicating between the functional end and a rearward portion of the member, and including a further source of pressure connectible along each said axial bore.

20. Apparatus as claimed in claim 19 wherein each of said first and second members has an cross bore communicating with the axial bore and that aligns with a respective pressure conduit when the functional ends of said member are reciprocated to a position adjacent said cross-passage.

21. Apparatus as claimed in claim 20 wherein each said pressure conduit comprises a bore extending within each of said first and second dies, respectively.

22. Apparatus as claimed in claim 14 wherein said first source of pressure connects with a portion of said cross passage on a side of said second passageway opposite said one side.

* * * * *

UNITED STATES PATENT AND TRADEMARK OFFICE

CERTIFICATE OF CORRECTION

PATENT NO. : 6,067,830
DATED : May 30, 2000
INVENTOR(S) : Klages et al

It is certified that error appears in the above-identified patent and that said Letters Patent is hereby corrected as shown below:

Page 1, col. 2,
After "0849012 6/1998 European Pat. Off." insert -- INFORMATION:

The assignee of the applicant has, since before July 28 1998 manufactured product in a facility located outside the United States in accordance with the procedure as described at col. 6 line 37 through col. 7 line 24 of the present specification, and has, since before July 28, 1998 sold such product into the United States. --

Signed and Sealed this

Seventeenth Day of July, 2001

Nicholas P. Godici

*Attest:*

NICHOLAS P. GODICI
*Acting Director of the United States Patent and Trademark Office*

*Attesting Officer*